US010347088B2

(12) United States Patent
Gordon

(10) Patent No.: US 10,347,088 B2
(45) Date of Patent: Jul. 9, 2019

(54) PICK POKER SYSTEMS AND METHODS

(71) Applicant: PSG Poker, LLC, Henderson, NV (US)

(72) Inventor: Philip Gordon, Newport, WA (US)

(73) Assignee: PSG Poker, LLC, Henderson, NV (US)

( * ) Notice: Subject to any disclaimer, the term of this patent is extended or adjusted under 35 U.S.C. 154(b) by 0 days.

(21) Appl. No.: 15/713,446

(22) Filed: Sep. 22, 2017

(65) Prior Publication Data

US 2018/0089958 A1 Mar. 29, 2018

Related U.S. Application Data

(60) Provisional application No. 62/399,151, filed on Sep. 23, 2016.

(51) Int. Cl.
*G07F 17/32* (2006.01)

(52) U.S. Cl.
CPC ..... *G07F 17/3293* (2013.01); *G07F 17/322* (2013.01); *G07F 17/326* (2013.01); *G07F 17/3209* (2013.01); *G07F 17/3244* (2013.01); *G07F 17/3258* (2013.01); *G07F 17/3276* (2013.01); *G07F 17/3288* (2013.01)

(58) Field of Classification Search
CPC ..... G07F 17/3293; G07F 17/3209; G07F 17/322; G07F 17/3244; G07F 17/326
USPC ..... 463/13, 16
See application file for complete search history.

(56) References Cited

U.S. PATENT DOCUMENTS 8,568,224 B1 * 10/2013 Itkis ..... G07F 17/3218 455/411
2006/0058085 A1 * 3/2006 White ..... A63F 13/10 463/11
2006/0073891 A1 * 4/2006 Holt ..... A63F 13/02 463/30

(Continued)

FOREIGN PATENT DOCUMENTS

GB 2462799 2/2010
RU 2 301 697 C2 6/2007

OTHER PUBLICATIONS

International Search Report and Written Opinion of the International Searching Authority completed Dec. 19, 2017, in International Patent Application No. PCT/US17/53101, 7 pages.

*Primary Examiner* — Jay Trent Liddle
*Assistant Examiner* — Ryan Hsu
(74) *Attorney, Agent, or Firm* — Benedict R. Dugan; Lowe Graham Jones PLLC

(57) ABSTRACT

Systems, methods, and devices for playing and managing a card game are described. The card game is known as "Pick Poker" and incorporates elements of traditional poker with that of paramutual wagering. A pool of common Community Cards are dealt, and players select their preferred starting hand from that pool of Community Cards. Subsequently, a pool of common Replacement Cards are dealt, and players complete a 5 card poker hand from the Replacement Cards. Each player's final poker hand consists of the cards they chose from the Community Cards in addition to cards selected from the Replacement Cards. Players with the best hand (as determined by the rules of the game) are awarded a at least some of the pot. In some versions, multiple players each having the best hand obtain equal shares of the pot.

10 Claims, 6 Drawing Sheets

(56) References Cited

U.S. PATENT DOCUMENTS

| | | | | |
|---|---|---|---|---|
| 2007/0060388 | A1* | 3/2007 | Stelzer | G07F 17/32 463/43 |
| 2007/0145684 | A1* | 6/2007 | Webb | G07F 17/32 273/292 |
| 2015/0045100 | A1 | 2/2015 | Alal | |
| 2016/0155291 | A1 | 6/2016 | Brown et al. | |

* cited by examiner

PICK POKER SYSTEMS AND METHODS

PRIORITY CLAIM

This application claims the benefit of U.S. Provisional Patent Application No. 62/399,151, entitled "PICK POKER" and filed on Sep. 23, 2016, the content of which is incorporated herein by reference in its entirety.

TECHNICAL FIELD

The present disclosure relates to methods, techniques, and systems for a new form of poker game play, where players ante or buy-in to a hand, select cards from a common pool of community cards and replacement cards, and then all players compare their made hands with the best poker hand or hands awarded the pot.

BACKGROUND

Poker is a game widely played around the world. Common variants such as five-card-draw, seven card stud, and Texas Hold'em all share a similar mechanism: players are dealt their own hand (the "hole cards") and then bet, raise, bluff, following the format of the game, until a comparison of hands is made and the pot awarded.

There are forms of poker, such as the common and popular Texas Hold'em, that employ community cards. In these variants, players have a hidden, private "hole" cards, then common "community cards" are dealt that the players can choose from in order to make a poker hand.

In forms of poker as they are played today, the combination of private "hole" cards and community cards presents players with unknown information. For example, in Texas Hold'em, each player is dealt two hole cards face down. This hidden information introduces complexity to the betting, allowing for bluffing, raising, and manipulation common to poker.

DETAILED DESCRIPTION

Figure 1:
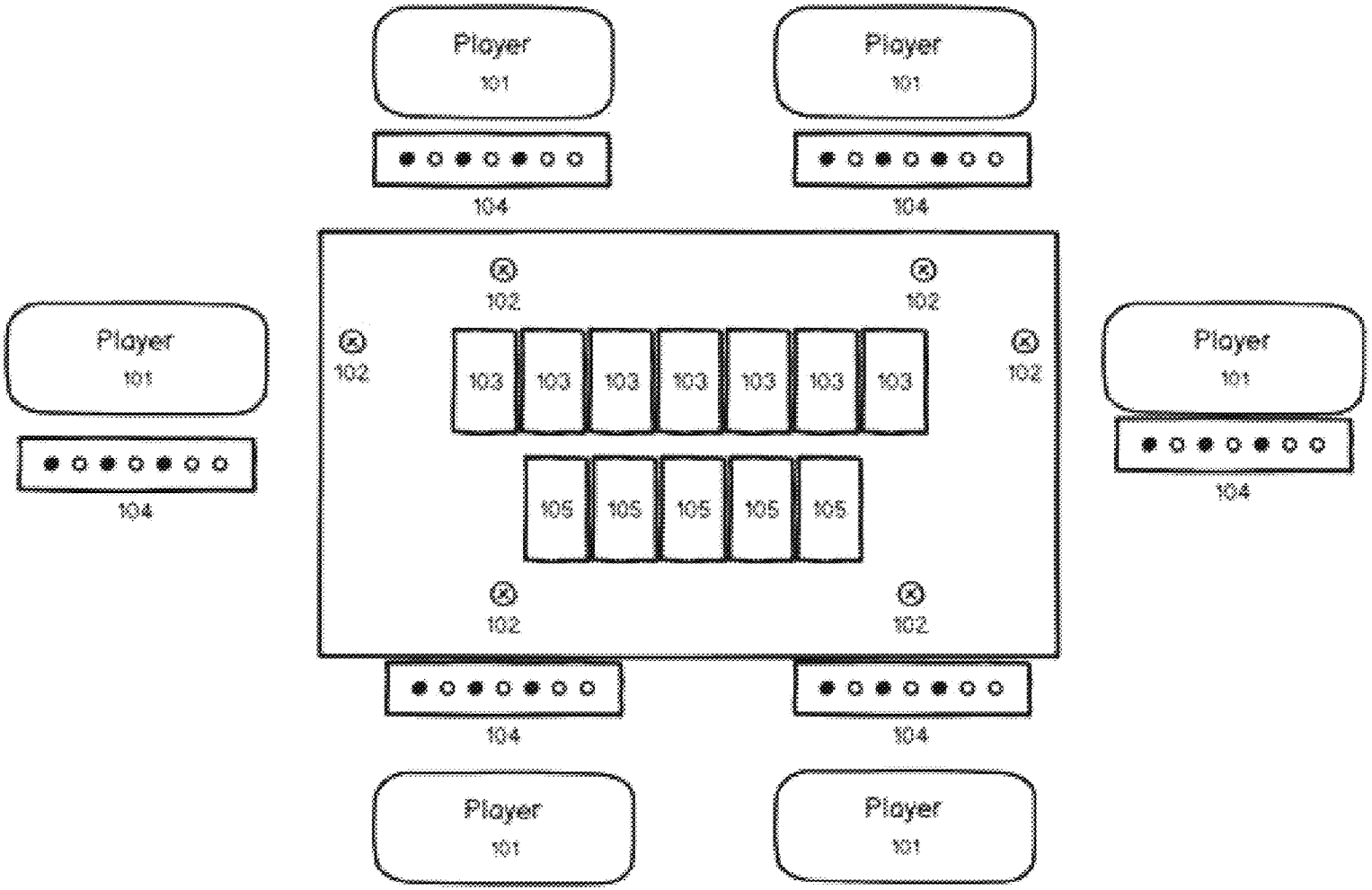
FIG. 1 illustrates a game according to a first embodiment.

The following Detailed Description provides specific details for an understanding of various examples of a new form of poker, herein referred to as "Pick Poker." One skilled in the art will understand that the game may be practiced without many of these details. In some instances, game details and mechanisms for play have not been shown or described in detail or at all to avoid unnecessarily obscuring the description of the examples of the game. It is intended that the terminology used in the description presented below be interpreted in its broadest reasonable manner, even though it is being used in conjunction with a detailed description of certain examples of the game.

Although certain terms may be emphasized below, any terminology intended to be interpreted in any restricted manner will be overtly and specifically defined as such in this Detailed Description section Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the words, "herein," "above," "below," and words of similar import, when used in this application, shall refer to this application as a whole and not to particular portions of this application. When the context permits, words using the singular may also include the plural while words using the plural may also include the singular. The word "or," in reference to a list of two or more items, covers all of the following interpretations of the word: any of the items in the list, all of the items in the list, and any combination of one or more of the items in the list.

Certain elements appear in various of the Figures with the same capitalized element text, but a different element number. When referred to herein with the capitalized element text but with no element number, these references should be understood to be largely equivalent and to refer to any of the elements with the same capitalized element text, though potentially with differences based on the embodiment within which the various embodiments of the element appears.

As used herein, a "Player" is a person participating in a game of poker. "Deck" refers to a standard deck of 52 playing cards, or any subset or superset of a standard deck of playing cards. "Community Cards" refers to a set of cards dealt that all players can access for use in a poker hand. "Replacement Cards" refer to a set of cards dealt that players may use in a poker hand.

1. Pick Poker Overview

Generally, the disclosed invention provides for a new variant of game play for poker. This form of poker follows this outline:

Players contribute to the "pot" in order to participate in a hand. This is commonly known as an Ante or a Bet.

A set of "Community Cards" are dealt. The Community Cards are shared by all players. Community Cards can be dealt face up, face down, or any combination of face up or face down, as determined by the house rules or dealer. Community cards can be any number of cards, based on the preference and dictates of the dealer or house rules. For instance, some variants may play with 7 Community Cards, with 3 face down and 4 face up. In another variant, there may be 5 Community Cards all face up. In another variant, there might be two rows of 5 Community Cards, with each player selecting a row and then up to 3 cards from the selected row.

After the Community Cards are dealt, each Player selects a "Starting Hand" from the Community Cards. Players either write down, click on selected cards, or otherwise definitively denote the cards they wish to use for their Starting Hard. The Player's selection can either be revealed or hidden, as the variant dictates. Player selection may happen concurrently, or sequentially as the variant dictates. The variant may also dictate that each starting hand selected must by unique amongst all the players playing the hand, or can be shared amongst several players.

After all Players have selected a Starting Hand, a number of "Replacement Cards" are dealt. For instance, in some variants, 5 Replacement Cards are dealt. In other variants, 7 Replacement Cards are dealt. Players select Replacement Cards from the pool of Replacement Cards dealt in order to constitute a desired poker hand. For example, suppose a player has selected a 3 card starting hand from the Community Cards. After the Replacement Cards are dealt, the player would select 2 to complete a 5 card poker hand.

After all Players have selected Replacement Cards, hand comparison takes place. Players with the best poker hand are awarded the pot. If more than one player has the best poker hand, those players are awarded an equal share of the pot. In some variants, the game can be played "High-Low" whereby the best poker hands are awarded ½ the pot, and the absolute worst poker hands are awarded ½ the pot. In some variants, where players compete for the best (high) and the worst (low) hand, multiple selection from the Replacement Cards may be permitted.

Pick Poker can be played electronically, with all players competing in the same field of play and playing the exact same hand concurrently. Pick Poker can also be played in a live poker game format. Pick Poker variants can also be played as a House Game, much like Blackjack, with the house taking a small portion of all bets. Pick Poker can also be played in a typical "poker tournament" format whereby stakes increase over time and players are eliminated from the pool when they no longer can post to play the next hand.

Pick Poker is interesting and unique because all players competing in a hand are playing from the exact same pool of cards at the exact same time. This is much like paramutual horse racing there bettors examine the odds of a horse winning and make a decision which horse to bet on, with the size of the payoff determined by the percentage of wagers placed on the winning horse. Unlike other forms of poker, in Pick Poker, there is no "unknown information" or "luck" component to the game. Despite the fact that all cards are shared by all players, the game is extremely skillful.

Take, for example, a Pick Poker game with 100 players. All players ante $1 to play the hand, creating a pot of $100. 7 Community Cards are dealt:

As Ad 9h 8d 7c 6s 5d

Some players may choose to "play it safe" and keep the Straight (98765). Others may "gamble" and try to make a higher hand by just keeping the 9876. And still others may want to attempt to beat all the players with straights by making a flush—they would keep Ad 8d 5d and hope for two diamonds in the Replacements. Still others may go for the super-long shot and just keep As Ad hoping to make a full house or four of a kind. It is these choices, the mathematical equilibriums and psychology of the players involved, and the possibility of a large "jackpot" (by keeping an obscure starting hand) that make Pick Poker so compelling and unique.

2. Example Games

FIG. 1 is a diagram showing 6 Players (101) in a poker game. In this example variant, the Players will place a Wager or Ante (102), indicating their entry into the poker hand. Players choose their Starting Hand from 7 Community Cards (103), keeping their selection secret. Each Player records their selection privately (either on paper, electronically, or other mechanism) (104). In this variant, 5 Replacement Cards are dealt (105). Players select from the Replacement cards, augmenting their selected Community Cards to make a five card poker hand. All players reveal their selections, and the best poker hands are awarded the pot, which is comprised of the totality of the antes (102) minus whatever fees are applied by the dealer.

Figure 2:
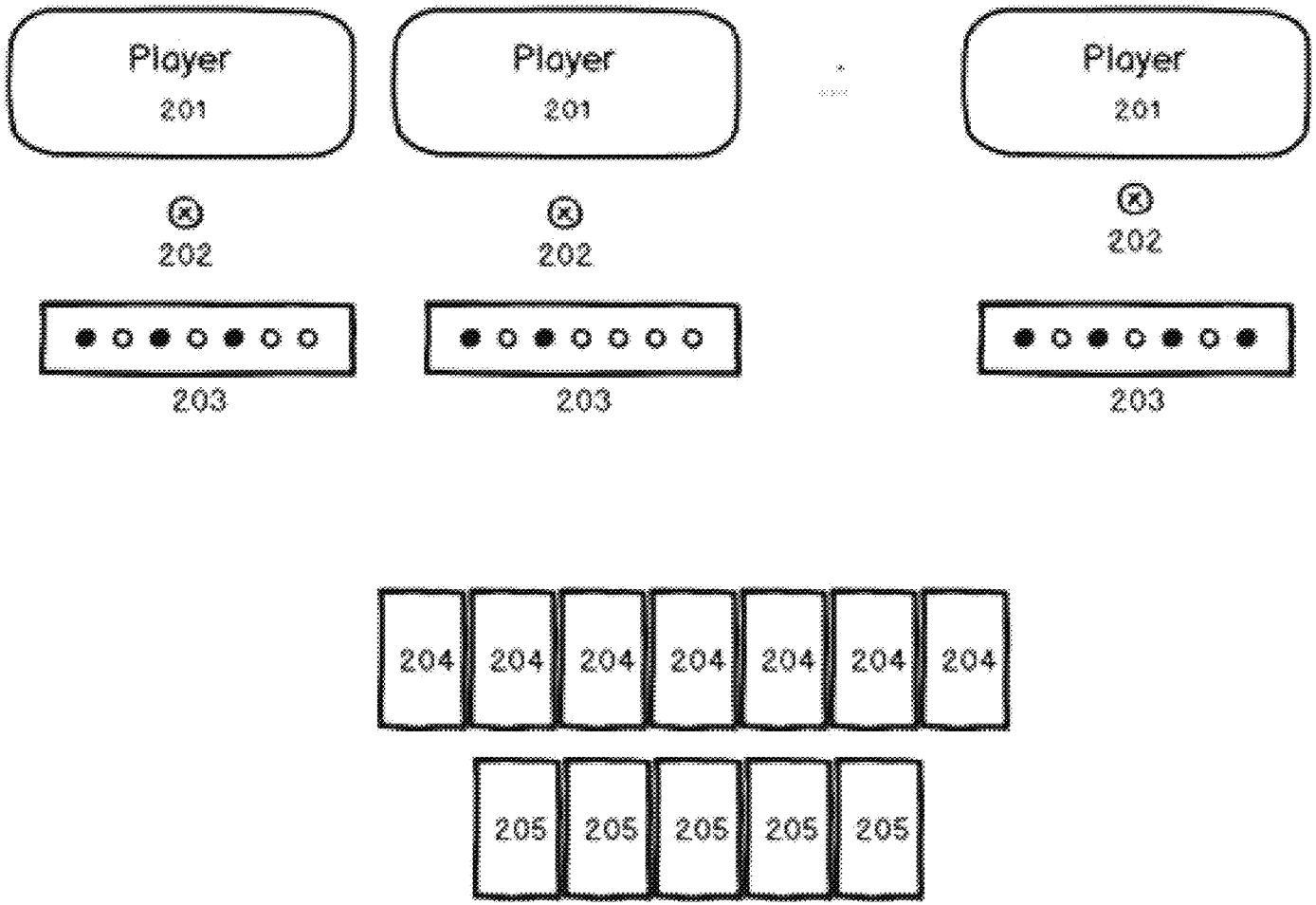
FIG. 2 illustrates a game according to a second embodiment.

FIG. 2 is a diagram showing 1000 Players (201) competing in Pick Poker electronically via computer. Players electronically place a Wager (202). After all Wagers have been submitted and recorded, Players select a Starting Hand (203) from the 7 Community Cards that are dealt (204). All Players are selecting from the exact same Community Cards. After all players have selected a Starting Hand, 5 Replacement Cards (205) are dealt. Players select from the Replacement Cards, forming a 5 card poker hand. All Players compare their poker hands, and the pot is awarded (or split) to Players with the winning hand.

Figure 3:
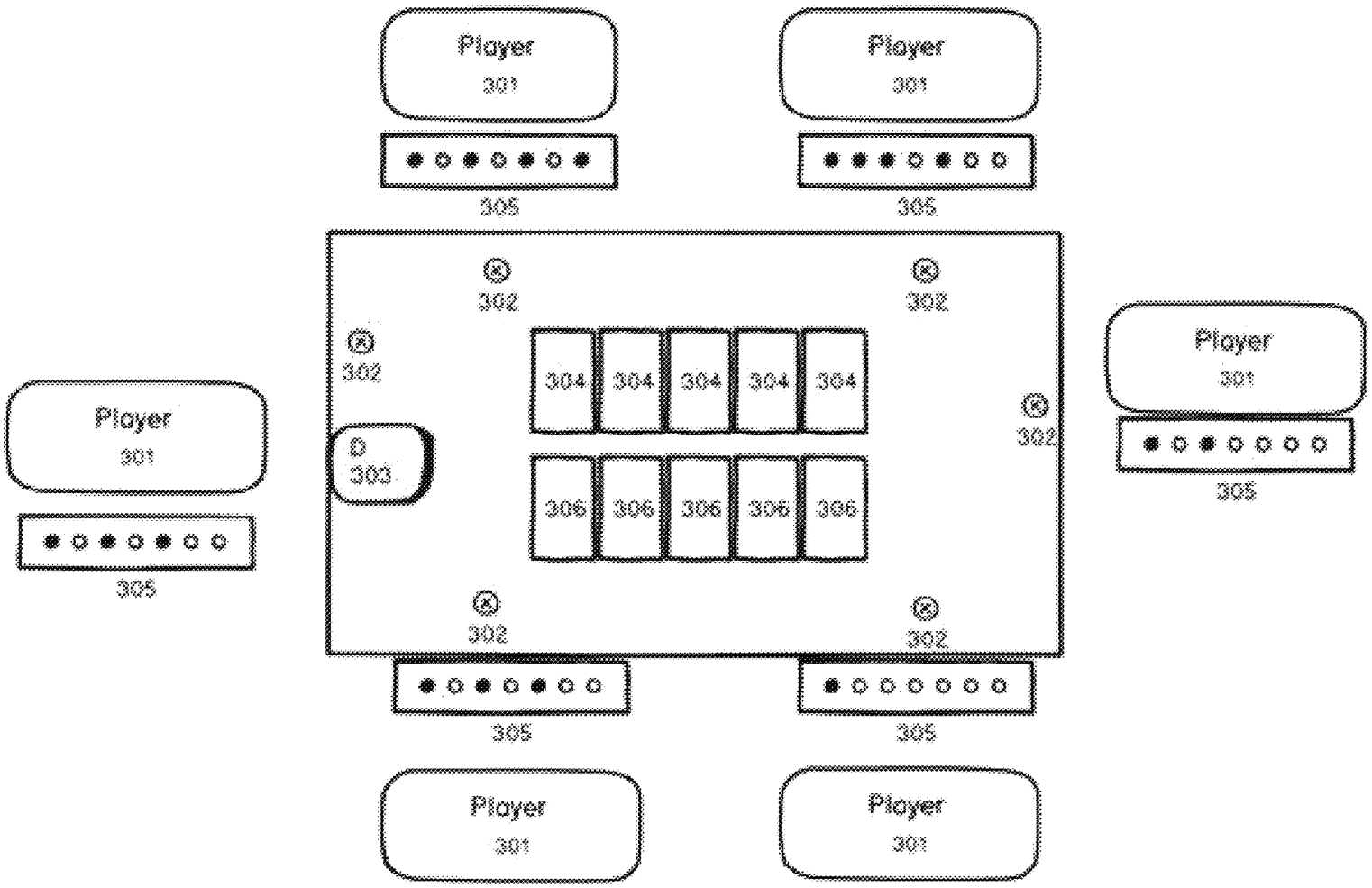
FIG. 3 illustrates a game according to a third embodiment.

FIG. 3 is a diagram showing 6 players (301) at a poker game. Each player antes (302). A Dealer Button (303) denotes the player that is last to act. 5 Community Cards (304) are dealt. The Player immediately to the left of the Dealer button is first to act, and publicly declares his Starting Hand (305) (a subset of the Community Cards). The next player to act declares a subset of the Community Cards. And so forth until each player at the table, ending with the player denoted by the Dealer Button, has declared their initial Starting Hand. Replacement Cards (306) are dealt, and each player chooses from the Replacement cards to augment their Starting Hand. The pot is awarded to those with the best hand.

Figure 4:
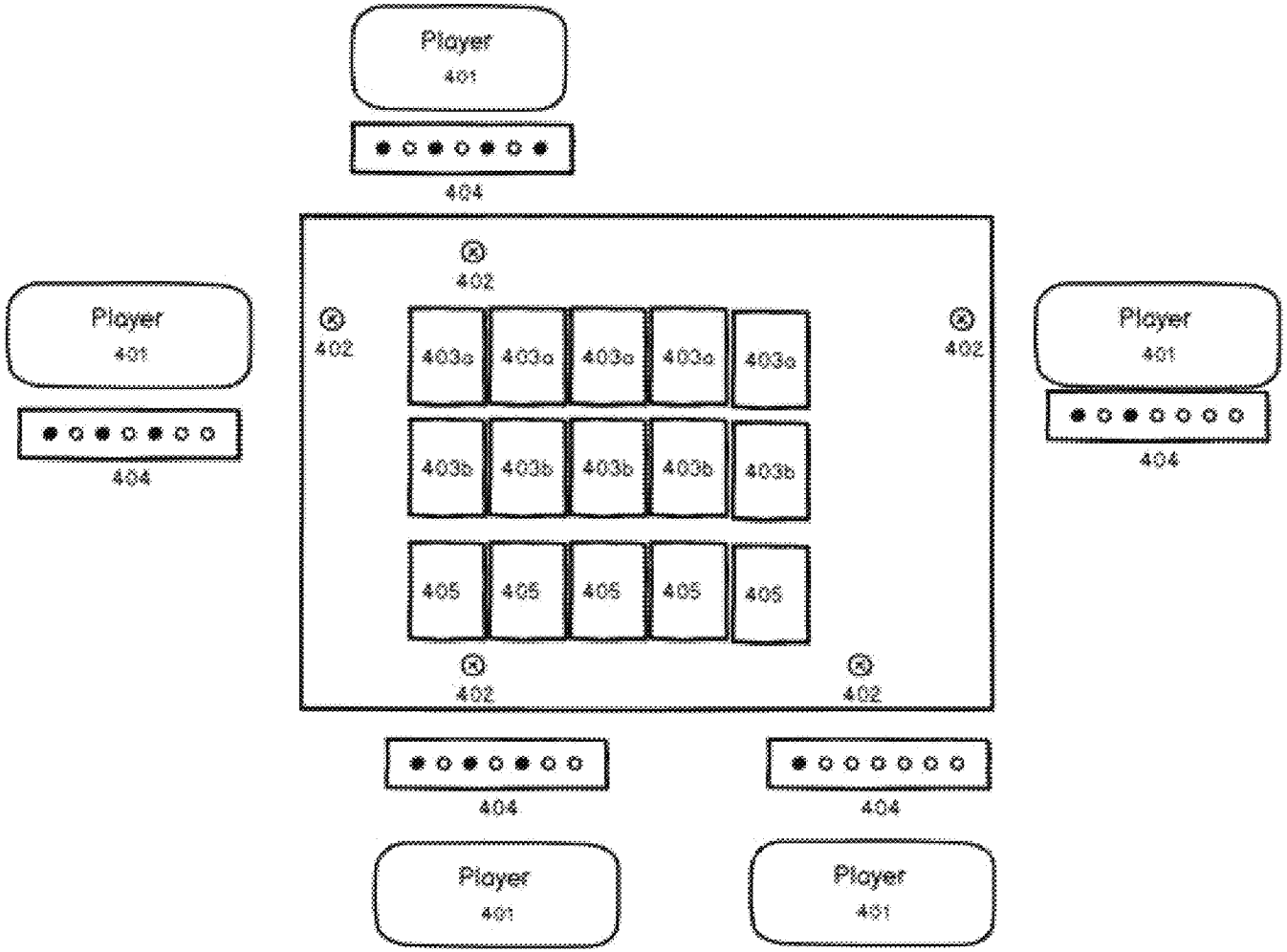
FIG. 4 illustrates a game according to a fourth embodiment.

FIG. 4 is a diagram showing 5 players (401) at a poker game. Players place a wager (402). 2 lines of 5 Community Cards (403*a*, 403*b*) are dealt. Each player picks a line, and then a subset of the cards in that line to form their Starting Hand (404). 5 Replacement Cards (405) are dealt. Each player chooses from the Replacement Cards to augment their Starting Hand. The pot is awarded to those with the best hand.

The variant games shown in FIGS. 1-4 and otherwise described herein may be implemented in various ways. Some embodiments facilitate gameplay via a client-server computing system implementation, such as is described with respect to FIG. 6, below. The client devices may be mobile computing devices, home computers, casino gaming machines, or the like.

Other embodiments provide a gaming table that facilitates gameplay. A gaming table may be arranged as shown in any one of FIGS. 1-4. One embodiment of the gaming table includes multiple selection devices, each of which include multiple buttons or other input devices that are configured to receive from a corresponding player a selection of community cards for the starting hand and a selection of replacement cards for the final hand. Each selection device may also include a visibility screen that is configured to hide a player's selection from other players. In other embodiments, the selections made by players are public, and no privacy screen is included. Each selection device may further include a finalization input device (e.g., button) that is used by the player to indicate that their card selection is final. Once finalized, the selection cannot be modified by the player or anyone else.

In some embodiments, the selection devices are touch-based input devices that are coupled to the gaming table and/or to game manager logic. The touch-based devices may be mobile devices (e.g., smart phones) that each execute an app or similar logic. In other embodiments, the touch-based devices may be physically coupled to the gaming table.

The manager logic is configured to manage gameplay, such as by determining when all players have made bets, selections, or the like. An example manager module is shown and described with respect to FIG. 6, below. In some embodiments, the selection devices also include a light or other signaling device that illuminates once a player has finalized his bet and/or card selection. In this manner, a dealer can see when it is time to move to the next phase of the game, such as the display of replacement cards, determination of the highest hand, distribution of winnings, or the like.

The manager logic may be incorporated into the table, such as via a computing device built in at the location where a full-time dealer would reside, such as in a casino context. In other embodiments, the manager logic may execute on a mobile dealer terminal, which is a mobile device (e.g., a tablet) that can be passed when the dealer role the game rotates to another player.

3. Example Processes

Figure 5:
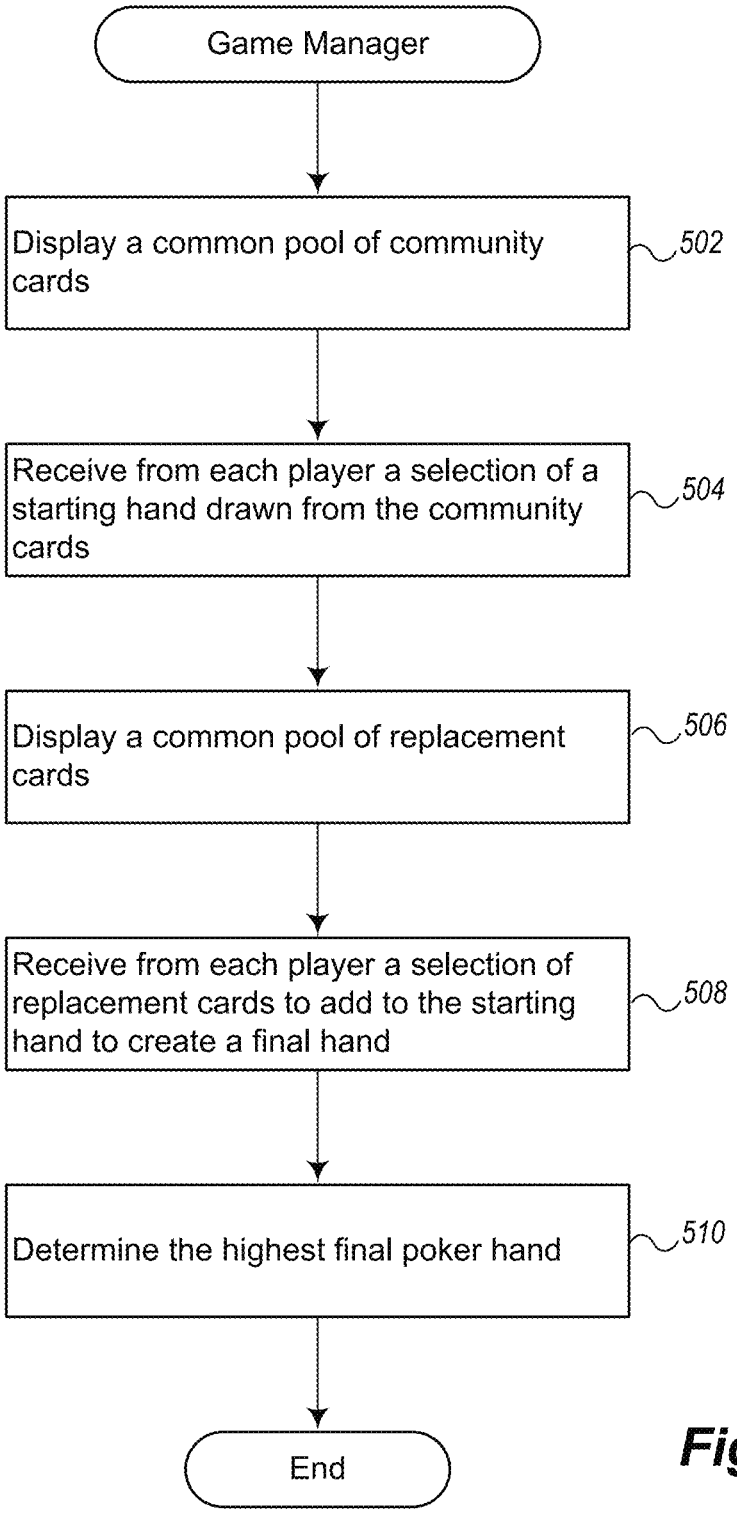
FIG. 5 is a flow diagram of a process according to an example embodiment.

FIG. 5 is a flow diagram of a process according to an example embodiment. The process may be performed by the game manager 100 described with reference to FIG. 6, below. The process may also be performed by a human, such as a dealer in a gaming context.

The illustrated process begins at block 502, where it displays a common pool of community cards. In wagering embodiments, the process may also collect an initial bet (e.g., ante) before displaying the community cards.

At block 504, the process receives from each player a selection of a starting hand drawn from the community cards. The starting hand may include zero or more cards. In wagering embodiments, the process also receives bets from each of the multiple players, the bets together forming a pot. The selections may be made privately by each player, so that any given player cannot see or otherwise obtain knowledge of the selections made by other players. In addition, selections are at some point finalized, such that they cannot be modified by players. The finalization may occur upon indication by a player (e.g., press of a button or switch), upon expiration of a time period, or some other condition or event.

At block 506, the process displays a common pool of replacement cards. The replacement cards are typically additional cards taken from the same deck that was used to produce the pool of community cards.

At block 508, the process receives from each player a selection of replacement cards to add to the starting hand. There may be zero or more replacement cards, depending on the number of cards in the starting hand. The player draws a sufficient number of replacement cards to create a full poker hand (e.g., 5 cards). Again, these selections may be made in private and are at some point finalized in order to prohibit modification.

At block 510, the process determines a highest final poker hand. In wagering embodiments, the process distributes at least some of the pot to each of the one or more players having the highest final poker hand. Typically equal portions of the pot are distributed to the players having the highest hands.

4. Example Computing System Implementation

Figure 6:
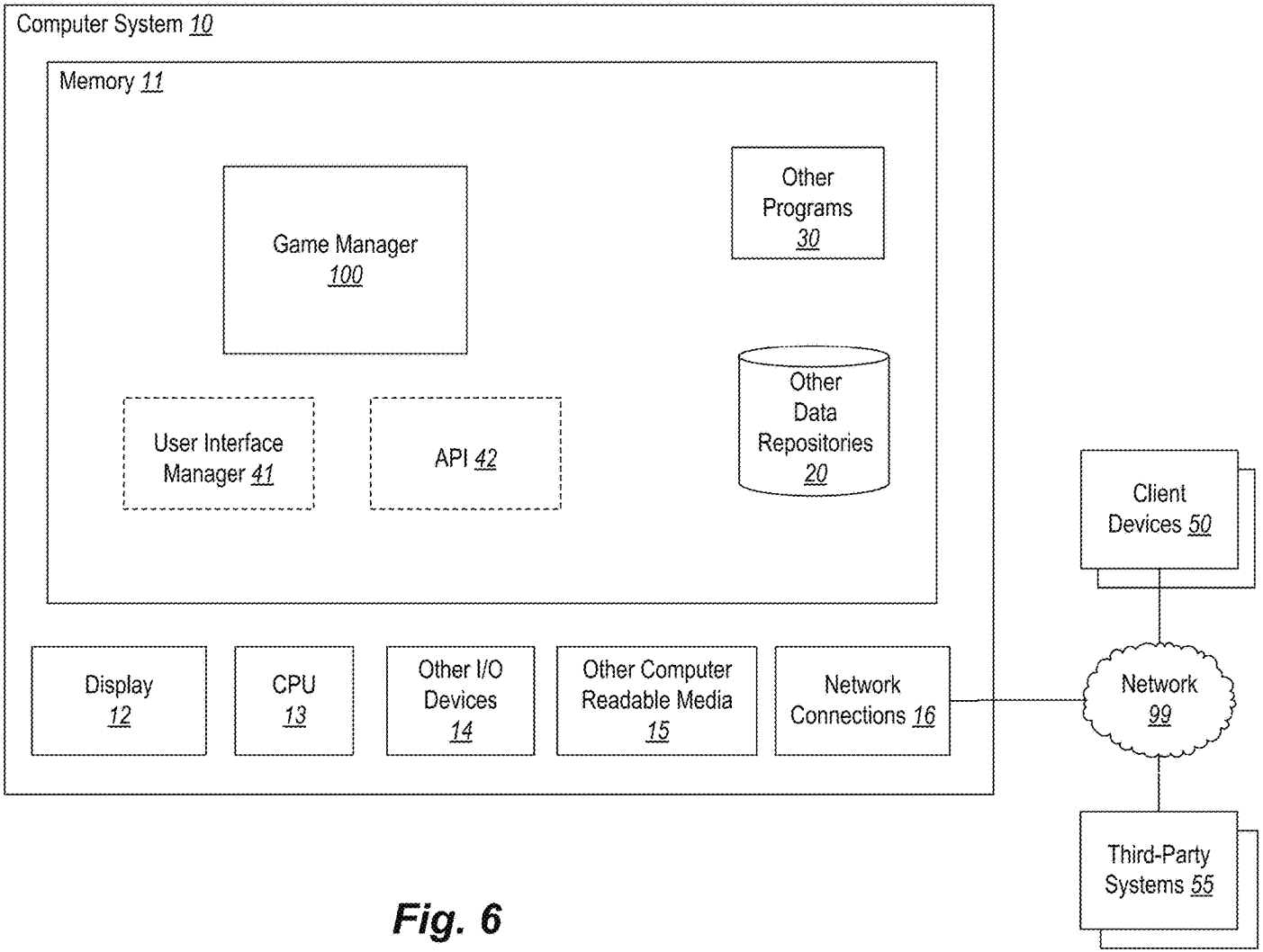
FIG. 6 is a block diagram of an example computing system for implementing a game manager according to an example embodiment.

FIG. 6 is a block diagram of an example computing system for implementing a Pick Poker game manager according to an example embodiment. In particular, FIG. 6 shows a computing system 10 that may be utilized to implement a game manager module 100 for managing a Pick Poker game. Also, at least some of the implementation techniques described below may be used to implement other devices, systems, or modules described herein.

Note that one or more general purpose or special purpose computing systems/devices may be used to implement the manager module 100. However, just because it is possible to implement the manager on a general purpose computing system does not mean that the techniques themselves or the operations (taken alone or in combination) required to implement the techniques are conventional or well known. In addition, the computing system 10 may comprise one or more distinct computing systems/devices and may span distributed locations. Furthermore, each block shown may represent one or more such blocks as appropriate to a specific embodiment or may be combined with other blocks. Also, the manager module 100 may be implemented in software, hardware, firmware, or in some combination to achieve the capabilities described herein.

In the embodiment shown, computing system 10 comprises a computer memory ("memory") 11, a display 12, one or more Central Processing Units ("CPU") 13, Input/Output devices 14 (e.g., keyboard, mouse, CRT or LCD display, and the like), other computer-readable media 15, and network connections 16. The manager module 100 is shown residing in memory 11. In other embodiments, some portion of the contents, some or all of the components of the manager module 100 may be stored on and/or transmitted over the other computer-readable media 15. The components of the manager module 100 preferably execute on one or more CPUs 13 and perform the techniques described herein. Other code or programs 30 (e.g., an administrative interface, a Web server, and the like) and potentially other data repositories, such as data repository 20, also reside in the memory 11, and preferably execute on one or more CPUs 13. Of note, one or more of the components in FIG. 6 may not be present in any specific implementation. For example, some embodiments may not provide other computer readable media 15 or a display 12.

The manager module 100 is shown executing in the memory 11 of the computing system 10. Also included in the memory are a user interface manager 41 and an application program interface ("API") 42. The user interface manager 41 and the API 42 are drawn in dashed lines to indicate that in other embodiments, functions performed by one or more of these components may be performed externally to the manager module 100.

The manager module 100 interacts via the network 99 with client devices 50 and third-party systems/applications 55. The network 99 may be any combination of media (e.g., twisted pair, coaxial, fiber optic, radio frequency), hardware (e.g., routers, switches, repeaters, transceivers), and protocols (e.g., TCP/IP, UDP, Ethernet, Wi-Fi, WiMAX) that facilitate communication between remotely situated humans and/or devices.

The client devices 50 are computing devices that are utilized by players to interact remotely with the game manager 100. The client devices 50 may be mobile devices such as tablets, smart phones, or the like. Each client device 50 executes logic (e.g., an app, Web browser, client program) that is configured to receive card selection, bets, user authentication, and the like. The client logic communicates securely with the game manager 100. Some embodiment employ unique session tokens (e.g., large random numbers generated by the manager 100) in order to authenticate and validate communication between a client and the manager 100. Such secure communication techniques ensure that other players cannot gain access to or modify the card selections made by other users.

Each client 50 and the manager 100 also employ a protocol to ensure finalization of card selections made by players. In one embodiment, upon receiving a card selection from a client 50, the manager 100 stores the selection persistently (e.g., in data store 30). Upon determining that the selection has been successfully stored, the game manager transmits an acknowledgment to the client 50. The acknowledgment may include the selection itself, so that the client 50 can confirm that the correct selection was received by the manager 100. Upon receiving the acknowledgment (and/or upon an earlier condition, such as transmission of the selection), the client 50 prohibits any further modification of card selection.

The third-party systems/applications 55 may include any systems that provide data to, or utilize data from, the manager module 100, including Web browsers, third-party security/monitoring systems, communication systems, and the like. For example, in wagering embodiments, the systems 55 may include payment systems that are used to process payments between the manager 100 and players.

The UI manager 41 provides a view and a controller that facilitate user interaction with the manager module 100 and its various components. For example, the UI manager 41 may provide interactive access to the manager module 100, such that users can interact with the manager module 100, such as to create new accounts, start new games, or the like. In some embodiments, access to the functionality of the UI manager 41 may be provided via a Web server, possibly executing as one of the other programs 30. In such embodiments, a user operating a Web browser executing on one of the client devices 130 or mobile devices 120 can interact with the manager module 100 via the UI manager 41.

The API 42 provides programmatic access to one or more functions of the manager module 100. For example, the API 42 may provide a programmatic interface to one or more functions of the manager module 100 that may be invoked by one of the other programs 30 or some other module. In this manner, the API 42 facilitates the development of third-party software, such as user interfaces, plug-ins, adapters (e.g., for integrating functions of the manager module 100 into Web applications), and the like.

In addition, the API 42 may be in at least some embodiments invoked or otherwise accessed via remote entities, such as code executing on one of the client devices 50. For example, a client device 50 may communicate a card selection or a bet to the manager 100 via the API 42.

In an example embodiment, components/modules of the manager module 100 are implemented using standard programming techniques. For example, the manager module 100 may be implemented as a "native" executable running on the CPU 13, along with one or more static or dynamic libraries. In other embodiments, the manager module 100 may be implemented as instructions processed by a virtual machine that executes as one of the other programs 30. In general, a range of programming languages known in the art may be employed for implementing such example embodiments, including representative implementations of various programming language paradigms, including but not limited to, object-oriented (e.g., Java, C++, C#, Visual Basic.NET, Smalltalk, and the like), functional (e.g., ML, Lisp, Scheme, and the like), procedural (e.g., C, Pascal, Ada, Modula, and the like), scripting (e.g., Perl, Ruby, Python, JavaScript, VBScript, and the like), and declarative (e.g., SQL, Prolog, and the like).

The embodiments described above may also use either well-known or proprietary synchronous or asynchronous client-server computing techniques. Also, the various components may be implemented using more monolithic programming techniques, for example, as an executable running on a single CPU computer system, or alternatively decomposed using a variety of structuring techniques known in the art, including but not limited to, multiprogramming, multithreading, client-server, or peer-to-peer, running on one or more computer systems each having one or more CPUs. Some embodiments may execute concurrently and asynchronously, and communicate using message passing techniques. Equivalent synchronous embodiments are also supported. Also, other functions could be implemented and/or performed by each component/module, and in different orders, and by different components/modules, yet still achieve the described functions.

The data store 30 may be implemented as one or more database systems, file systems, or any other technique for storing such information, or any combination of the above, including implementations using distributed computing techniques. Access to such data may be provided via various mechanisms, including through programming language interfaces, data access libraries, live databases, client-server models (e.g., Web or FTP servers), or the like.

Different configurations and locations of programs and data are contemplated for use with techniques of described herein. A variety of distributed computing techniques are appropriate for implementing the components of the illustrated embodiments in a distributed manner including but not limited to TCP/IP sockets, RPC, RMI, HTTP, Web Services (XML-RPC, JAX-RPC, SOAP, and the like). Other variations are possible. Also, other functionality could be provided by each component/module, or existing functionality could be distributed amongst the components/modules in different ways, yet still achieve the functions described herein.

Furthermore, in some embodiments, some or all of the components of the manager module 100 may be implemented or provided in other manners, such as at least partially in firmware and/or hardware, including, but not limited to one or more application-specific integrated circuits ("ASICs"), standard integrated circuits, controllers executing appropriate instructions, and including microcontrollers and/or embedded controllers, field-programmable gate arrays ("FPGAs"), complex programmable logic devices ("CPLDs"), and the like. Some or all of the system components and/or data structures may also be stored as contents (e.g., as executable or other machine-readable software instructions or structured data) on a computer-readable medium (e.g., as a hard disk; a memory; a computer network or cellular wireless network or other data transmission medium; or a portable media article to be read by an appropriate drive or via an appropriate connection, such as a DVD or flash memory device) so as to enable or configure the computer-readable medium and/or one or more associated computing systems or devices to execute or otherwise use or provide the contents to perform at least some of the described techniques. Some or all of the components and/or data structures may be stored on tangible, non-transitory storage mediums. Some or all of the system components and data structures may also be stored as data signals (e.g., by being encoded as part of a carrier wave or included as part of an analog or digital propagated signal) on a variety of computer-readable transmission mediums, which are then transmitted, including across wireless-based and wired/cable-based mediums, and may take a variety of forms (e.g., as part of a single or multiplexed analog signal, or as multiple discrete digital packets or frames). Such computer program products may also take other forms in other embodiments. Accordingly, embodiments of this disclosure may be practiced with other computer system configurations.

All of the above U.S. patents, U.S. patent application publications, U.S. patent applications, foreign patents, foreign patent applications, non-patent publications, and appendixes referred to in this specification and/or listed in the Application Data Sheet, including but not limited to U.S. Provisional Application No. 62/399,151, entitled "PICK POKER" and filed on Sep. 23, 2016, is incorporated herein by reference, in its entirety.

The invention claimed is:

1. A gaming table configured to manage play of a card game wherein multiple players select hands from a common pool of community cards and replacement cards, with winning hands each awarded a share of a pot, the gaming table comprising:

multiple selection devices, each selection device including:

multiple buttons that are configured to receive from a corresponding player a selection that indicates zero or more community cards that are part of a starting hand for the player;

a visibility screen that keeps the received selection private from other players at the gaming table; and a finalization button configured, when selected, to prohibit modification of the selection of the starting hand and to transmit a selection finalization signal, wherein each of the selection devices includes an indicator light that is illuminated upon receipt of the selection finalization signal, and wherein the gaming table further comprises a computer device including logic to:

determine whether each of the selection devices has transmitted its selection finalization signal; and when all of the selection devices have transmitted their selection finalization signals, enable distribution of a common pool of replacement cards.

2. The gaming table of claim 1, wherein each of the selection devices is a touch screen device coupled to the table, wherein each of the multiple buttons is a touch sensitive button displayed upon the touch screen of the device, and wherein the touch screen device is configured to transmit card selections and finalization signals to a mobile dealer terminal that is configured to record the card selections and finalization signals.

3. The gaming table of claim 1, wherein each of the selection devices is further configured to receive from each of the multiple players a selection that indicates zero or more of replacement cards from a common pool, wherein the replacement cards are to be added to the starting hand to form a final poker hand for the player.

4. The gaming table of claim 1, wherein each of the selection devices is further configured to receive from each of the multiple players a selection that indicates zero or more replacement cards from the common pool of replacement cards, wherein the replacement cards are to be added to the starting hand to form a final poker hand for the player, and wherein the logic is further configured to, after selection of replacement cards by all of the selection devices, cause display of the final hands selected by each of the players.

5. The gaming table of claim 1, wherein the logic is further configured to perform operations including:

displaying a common pool of community cards;

receiving from each of the multiple players a selection that indicates zero or more of the community cards that are part of a starting hand for the player;

displaying a common pool of replacement cards;

receiving from each of the multiple players a selection that indicates zero or more of the replacement cards that are to be added to the starting hand to form a final poker hand for the player; and determining the highest final poker hand.

6. The gaming table of claim 5, wherein the logic is further configured to perform operations including:

before displaying the common pool of community cards, receiving bets from each of the multiple players, the received bets together forming a pot; and after determining the highest final poker hand, distributing at least some of the pot to each of one or more players having the highest final poker hand.

7. The gaming table of claim 6, wherein distributing at least some of the pot includes distributing the pot in equal portions to each of the one or more players having the highest final poker hand.

8. The gaming table of claim 7, wherein the received selections are made privately by each of the players, such that no player knows the selections made by the other players.

9. The gaming table of claim 8, wherein the logic is further configured to perform operations including:

keeping the received selection private from other players at the gaming table; and prohibiting modification of the selection after receipt of a selection finalization signal.

10. The gaming table of claim 5, wherein, for each player, the sum of the number of selected community cards and the number of selected replacement cards is five cards.

* * * * *